United States Patent [19]

Deloy et al.

[11] 3,963,181

[45] June 15, 1976

[54] FOOD RECLAIMING SYSTEM

[75] Inventors: Joseph T. Deloy, Lyndhurst, N.J.; Grant J. Selch, Schenectady, N.Y.

[73] Assignee: Nabisco, Inc., East Hanover, N.J.

[22] Filed: May 19, 1975

[21] Appl. No.: 578,616

[52] U.S. Cl. ..... 241/76; 241/79.1; 241/235

[51] Int. Cl.[2] ..... B02C 23/38

[58] Field of Search ..... 241/76, 79.1, 79.2, 241/92, 93, 152 A, 154, 221, 223, 227, 235

[56] References Cited

UNITED STATES PATENTS

| | | | |
|---|---|---|---|
| 1,749,925 | 3/1930 | Schaefer | 241/76 |
| 3,596,842 | 8/1971 | Barber | 241/79.2 |
| 3,834,630 | 9/1974 | Nelson | 241/152 A |

*Primary Examiner*—Granville Y. Custer, Jr.
*Attorney, Agent, or Firm*—Gerald Durstewitz; I. Allen Strombeck

[57] ABSTRACT

A system for producing cracker meal by reclaiming baked products such as crackers and cookies from broken and rejected packages. The packages are shredded to break up the product and reduce the packaging material to strips so as to release most of the product from the confinement of the package. The strips of packaging material which are free of product are separated by aspiration from the product prices and the package portions, such as corners, still containing product pieces. The product pieces and remaining wrapper sections are passed through a mill which reduces the product pieces to a fine meal without cutting the wrapper pieces. The cracker meal is separated from these wrapper pieces by means of a shaker screen.

10 Claims, 14 Drawing Figures

5-
5.

Fig. 5.
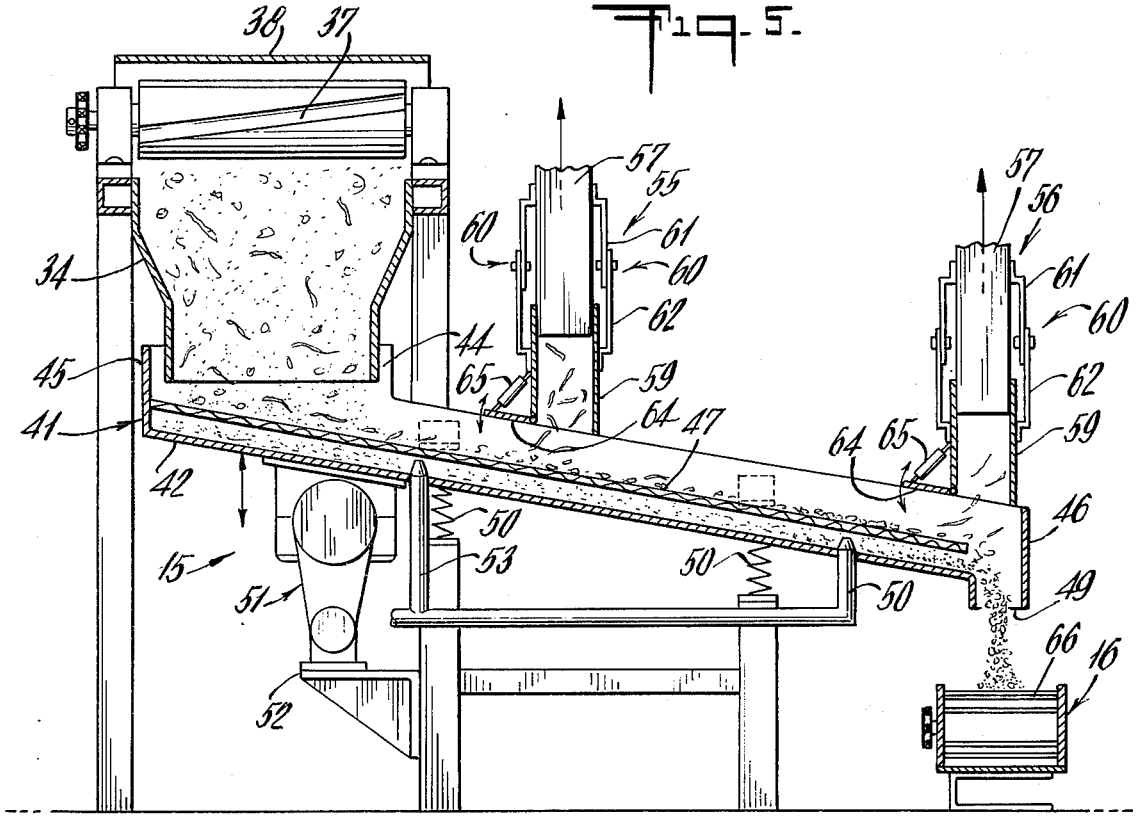
Fig. 6.
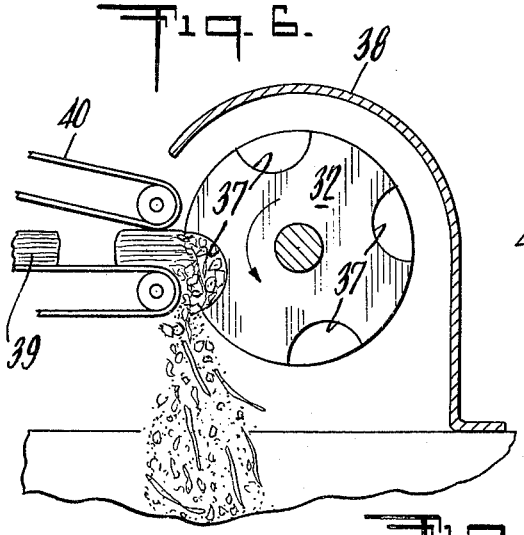
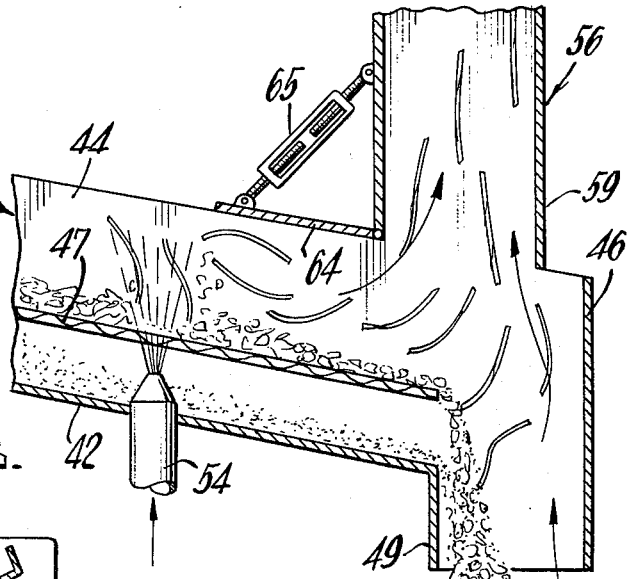
Fig. 8.
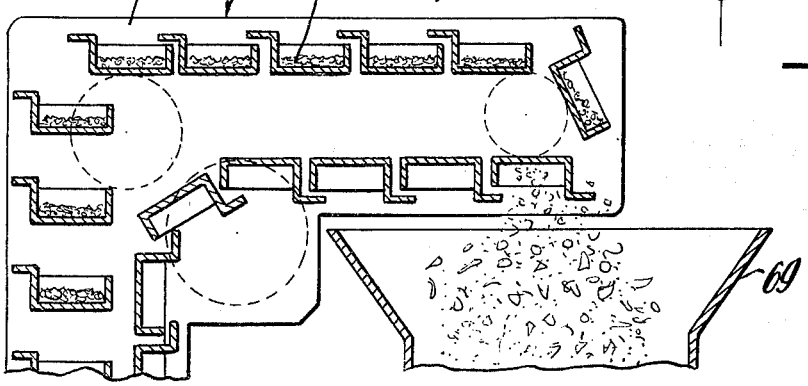
Fig. 7.
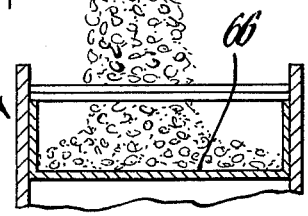

10.
12.
A
B

FOOD RECLAIMING SYSTEM

BACKGROUND OF THE INVENTION

The present invention relates to the separation of product from wrapping material in defective packages.

In the cookie and cracker industry, there are occasions when a malfunction in a production line causes product pieces or wrapped packages to be broken or otherwise rendered unusable. Product pieces damaged before packaging are normally recycled by grinding them to a meal and using the meal as an ingredient of the products produced.

When the product pieces are damaged after packaging, or when the package is damaged or improperly formed, it is common practice not to recycle the product because of the high cost of manually separating the product from the wrapping material. The rejected packages therefore must be disposed of at a considerable loss to the manufacturer.

SUMMARY OF THE INVENTION

It is an object of the present invention to provide a system for processing packages of edible products to economically separate the edible products from the packaging material.

Another object is to provide such a system which produces comminuted edible product usable as an ingredient in baked products.

Another object is to provide such a system which is simple and effective.

The foregoing objects are accomplished by providing a system for producing comminuted edible product by reclaiming baked products in rejected packages comprising in combination a device for shredding the packaging material and dividing the product into pieces, and aspirating device for separating unencumbered wrapper shreds from the remainder, means for comminuting all of the product pieces in the remainder without cutting the wrapper sections, and means for separating the comminuted product from the remaining wrapper pieces.

BRIEF DESCRIPTION OF THE DRAWINGS

A preferred embodiment of the invention has been chosen for purposes of illustration and description, and is shown in the accompanying drawings forming a part of the specification, where:

FIG. 3 is a side view partly in section of a portion of the system taken along the line 3—3 on FIG. 2.

FIG. 5 is a sectional view taken along line 5—5 on FIG. 3.

FIG. 6 is an enlarged view of a portion of FIG. 3 illustrating the action of the cutter.

FIG. 7 is an enlarged view of a portion of FIG. 5 illustrating the operation of the aspirating device.

FIG. 8 is a sectional view of the upper portion of the conveyor transporting the output of the aspirating device to the hopper feeding the grinding mill.

DESCRIPTION OF THE PREFERRED EMBODIMENT

Figures 1, 2:
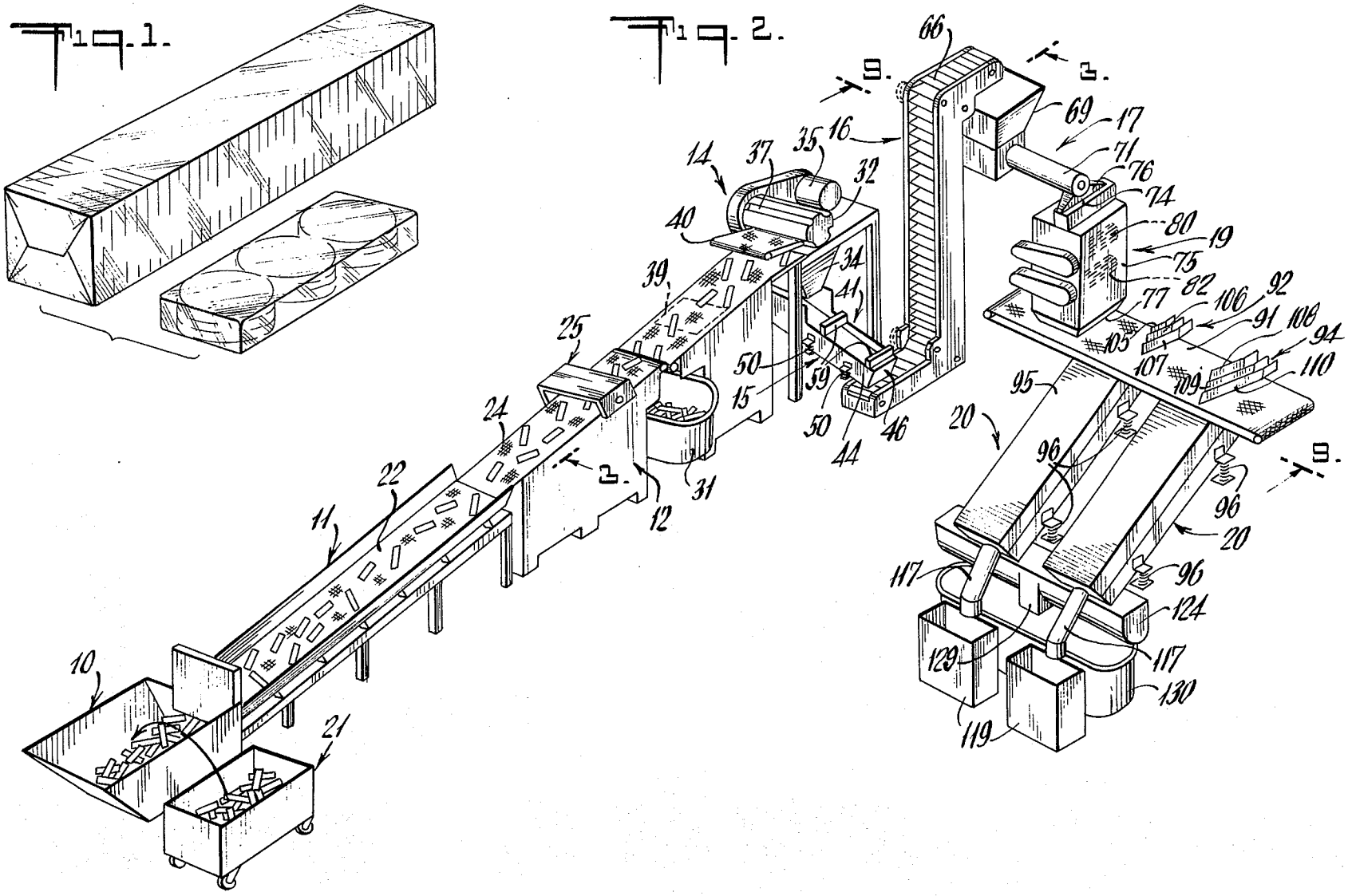
FIG. 1 is a isometric view of two cracker packages illustrating the type of product reclaimed by the subject invention.
FIG. 2 is an isometric view of a system according to the present invention.

Referring to the drawings in detail, and particularly to FIG. 2 thereof, there is shown a food reclaiming system according to the present invention which includes a hopper 10, a vibratory feeder 11, a metal dector 12, a cutter 14, a screen separator 15, a bucket conveyor 16, an auger feeder 17, a grinding mill 19, and a pair of screen separators 20.

Rejected cookie and cracker packages. for example of the type shown in FIG. 1, are brought to the hopper 10 in wheeled bins 21. The bins are lifted and dumped by a conventional dumping mechanism (not shown) to transfer the contents into the hopper 10. The packages feed out the bottom of the hopper onto the vibratory feeder 11 which delivers the packages to a metal detector unit 12. The feeder 11 is of conventional design in which the surface 22 thereof is oscillated in its longitudinal direction and vertically so as to impell the packages up the incline. The prime function of the vibratory feeder is to spread the packages over the surface 22 so that a single layer of packages is fed to the cutter 14.

Figures 2, 4:
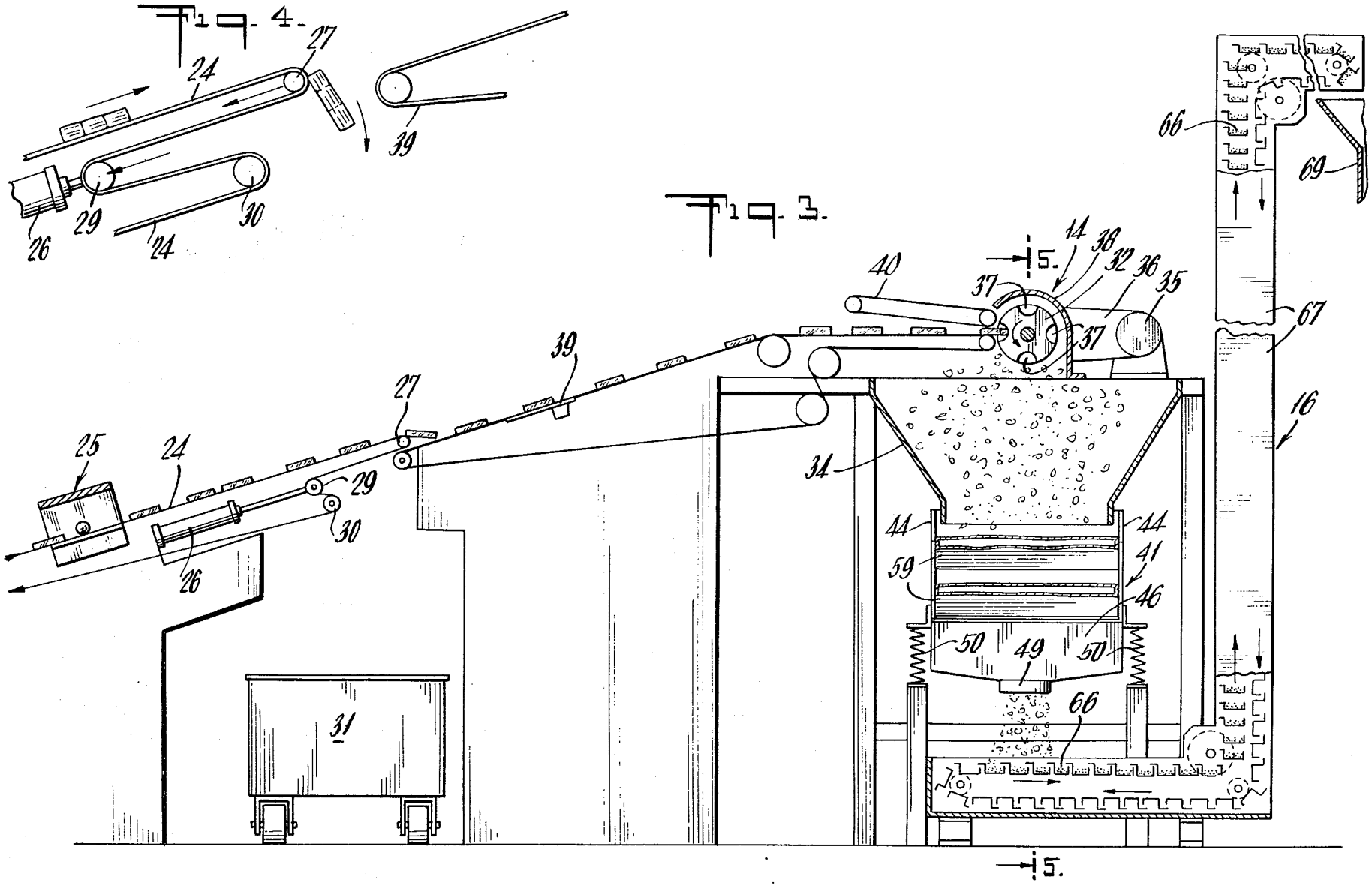
FIG. 4 is an enlarged view of a portion of the conveyor shown in FIG. 3 illustrating the action of a dump mechanism in respond to the detection of metal.

The metal detector includes, as shown in FIGS. 2, 3 & 4, a conveyor belt 24 a detecting head 25, and a conveyor retracting actuator 26 for dumping the material on a section of the belt 24 when metal is present therein. The belt 24 extends around a roller (not shown) under the end of surface 22, under the detecting head 25 and around rollers 27, 29 and 30. The roller 27 is slideably mounted and is spring biased into the position shown in FIG. 3. The roller 29 is also slideably mounted and is moved by the actuator 26 between the positions shown in FIGS. 3 and 4. The roller 30 is rigidly mounted. When no metal is present on the conveyor, the actuator 26 is extended and the roller 27 is held (by biasing springs) over the end of the conveyor belt that feeds the cutter 14 so that the packages feed continuously to the cutter. Should a piece of metal be present on the belt 24, it activates the detecting head as it passes thereunder which in turn energizes the actuator 26. As the actuator retracts, the roller 29 moves to the left (as viewed in FIGs. 3 and 4) tensioning the belt and drawing the roller 27 to the left so that the contents of the conveyor drop into a bin 31. The detecting unit is located at a point along the conveyor belt 24 to allow the actuator to operate before a detected piece of metal reaches the roller 27. After a predetermined period of time the metal detector resets to continue supplying packages to the cutter 14.

The cutter 14 includes a cutting roller 32 mounted over a hopper 34 and driven by an electric motor 35 through a drive train 36. The roller 32 is formed with four wide longitudinal grooves 37 in the form of half circles. The grooves 37 are inclined at an angle of about 6° to 8° to the axis of the roller, and, as shown in FIG. 6, the grooves are wide in comparison to the thickness of the packages fed thereto. A cover 38 is mounted over the roller 32.

As best shown in FIG. 3, a conveyor belt 39 receives the packages from the belt 24 of the metal detector and an upper conveyor belt 40 positioned at the cutting roller 32 cooperates with the belt 39 to firmly hold the packages as they are fed into the cutting roller. The speed of rotation of the roller 32 in proportion to the speed of travel of the belt 39 is such that the belt 39 advances about 1 inch for each revolution of the roller The cutting roller therefore slices the packages into ¼ inch wide strips. The crackers and cookies being relatively brittle break into small pieces, the largest of which are about ¼ inch by ½ inch. The wrapper material is cut into ¼ inch wide shreds.

Referring now to FIGS. 5 and 7, the screen separator 15 includes a sheet metal trough 41 having a bottom wall 42 side walls 44 and end walls 45 and 46. A screen 47 is mounted in the trough above the bottom wall 42 and extends from the end wall 45 toward the end wall 46. The trough 41 is formed with an outlet 49 in the bottom wall 42 at the end of the screen 47.

The trough is mounted on four springs 50, and a shaker mechanism 51 is positioned between a frame support 52 and the bottom wall 42 of the trough. The shaker mechanism moves the trough in an oscillatory manner to move the chopped material from the hopper down the length of the screen. The shaking motion also causes the heavy particles to settle while the lighter wrapping material tends to migrate toward the top of the material.

Two rows of air jets 53 and 54 are positioned in the bottom wall of the trough and are directed upwardly to turn over the material on the screen. Any powdered product resting on or adhering to strips of packaging material is thus dislodged so it may fall through the screen. Also the packaging material strips are lifted to the top of the material so that they be removed by aspiration.

A pair of rectangular aspirating ducts 55 and 56 extend across the full width of the trough between the side walls 44. The ducts include an upper section 57 which is supported by structural members not shown, and a lower section 59 of larger cross-section which telescopes over the upper section to be vertically adjustable with respect to the screen 47. The upper duct section 57 is connected to a suction device to induce a flow of air into the mouth of the lower duct section 59, to draw the wrapper shreds into the ducts. The height of the mouth of the section 59 is adjusted by means of a pair of adjustable supports 60. Each support includes a bracket 61 attached to the upper duct section 57 and a bracket 62 attached to the lower duct section 59. The free ends of the brackets overlap and are provided with a series of holes which are selectively aligned to receive a bolt to hold the lower duct section at the desired level. A flap 64 is hinged to the upstream edge of the mouth of each of the ducts 55, 56 and is adjustably positioned by a turnbuckle 65. The flaps 64 extend along the full width of the ducts. The height of the ducts and the angle of the flaps 64 are adjusted according to the type and quantity of product being treated to provide the most efficient aspiration of wrapper shreds. The adjustments are such that the air flow at the surface of the material on the screen is sufficient to lift the wrapper shreds but will not lift cookie or cracker pieces or wrapper pieces containing cookie or cracker pieces of significant size.

As the material moves down the screen from the hopper, it is agitated by the first set of jets. The wrapper shreds being lighter tend to settle back to the screen last and generally occupy the top layer of the material. The shaking action of the screen separator further tends to move the heavier eatable material downwardly with respect to the lighter wrapper shreds. As the material flows past the mouth of the duct 55, the wrapper shreds on the surface are drawn off through the duct. The material is turned over again by the jets 54 to move the remaining wrappers shreds to the surface. As the material moves under the duct 56 the surface shreds are drawn off. As best seen from FIG. 7, the duct 56 is positioned at the end of the screen overlapping the outlet 49 of the trough. The air flow into the mouth of the duct thus includes a stream which flows upwardly through the outlet 49. As the material flows over the edge of the screen, any remaining shreds are fully exposed to the upward air flow and are drawn off.

The material flowing out of the outlet 49 is mostly edible product pieces and powder. At this point 99% of the wrapping material has been removed. The remaining wrapping material consist essentially of tear strips, which are of high density and are not easily aspirated, and wrapper pieces such as package corners which are weighted down by product pieces lodged therein.

The bucket conveyor 16, receives the material from the outlet 49 and carries it to the auger feeder 17 mounted above the grinding mill 19. The conveyor 16 and the feeder 17 are utilized to provide a steady evenly distributed flow of material into the grinding mill 19.

The bucket conveyor 16 includes a plurality of individual buckets 66 mounted on a chain which extends around a series of sprocket wheels within a housing 67. The attitude of the buckets is determined by the action of an elongated cam element within the housing upon individual cam followers carried by the buckets.

The auger feeder 17 includes an infeed hopper 69, a ribbon screw 70 journalled in a housing 71, a motor 72 driving the screw, and an outlet duct 74. The pitch of the screw 70 is short at the input end under the hopper and lengthens progressively toward the output end to prevent the material from packing in the housing. The outlet duct 74 tapers in two directions. It widens in the direction transverse to the screw and it narrows in the direction parallel to the screw so as to distribute the material flowing into the mill into a thin wide stream.

Figures 9, 10, 11:
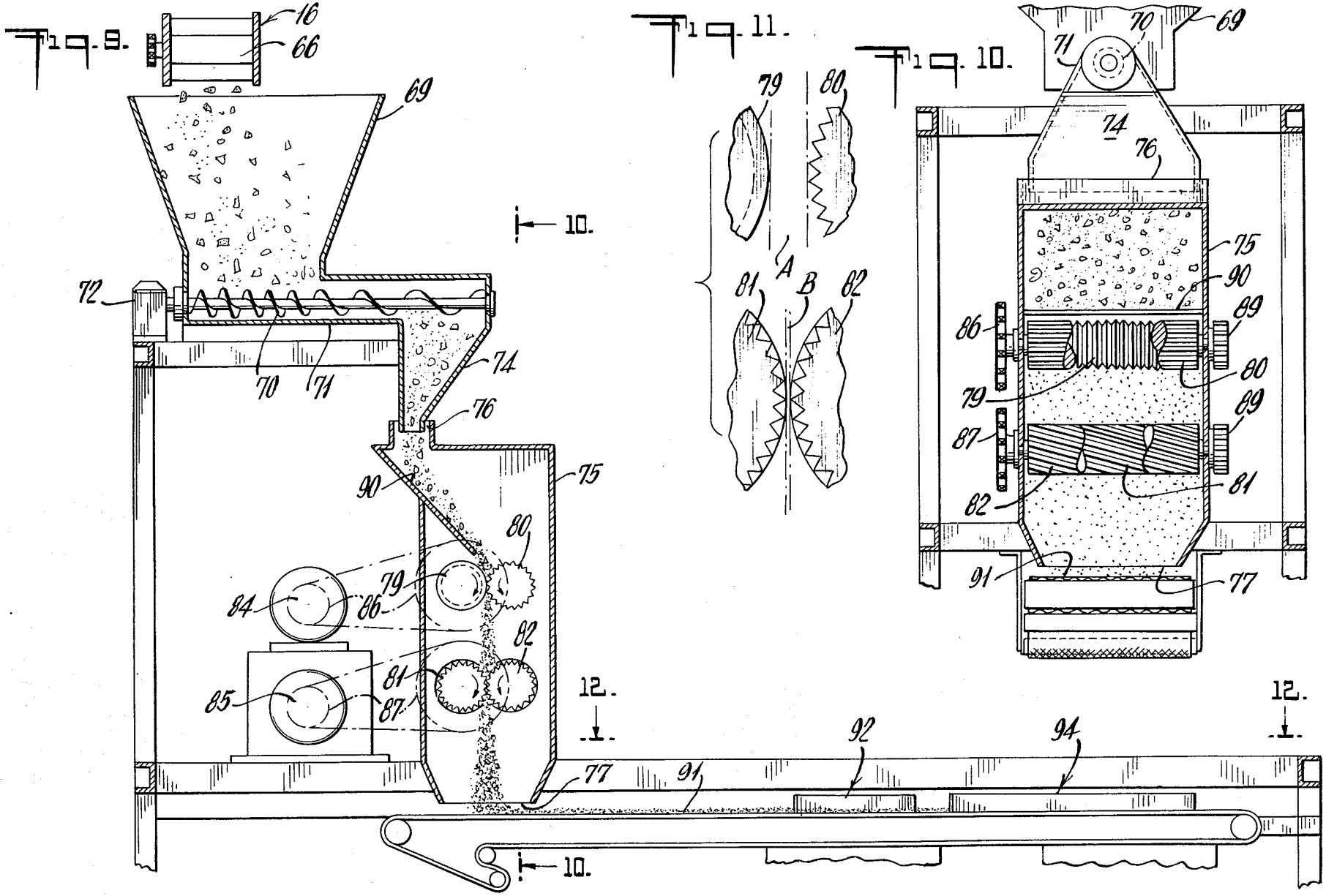
FIG. 9 is a sectional view taken along line 9—9 on FIG. 2.
FIG. 10 is a sectional view of the grinding mill taken along line 10—10 on FIG. 9.
FIG. 11 is an enlarged view showing the spacing of the opposed rollers of the grinding mill.

The grinding mill 19 includes a casing 75 having an inlet 76 on the top thereof at one side and an outlet 77 at the bottom thereof. Two pairs of grinding rolls extend horizontally across the casing one above the other and are journalled in the side walls of the casing. The upper pair of rolls include a roll 79 formed with circumfrentially oriented teeth and a roll 80 formed with horizontally oriented teeth. The rolls 79 and 80 are positioned so that the spacing between the tips of the facing teeth (the distance A on FIG. 11) is about 110/1000 inch. The lower pair of rolls includes two identical rolls 81 and 82 each having teeth oriented at an angle of about 15 degrees to the horizontal. The rolls 81 and 82 are spaced so that the distance between the tips of the facing teeth (the distance B on FIG. 11) is between 10/1000 and 15/1000 inch. The rolls 81 and 82 are positioned directly below the rolls 79 and 80 and the rolls 79 and 81 are driven by motors 84 and 85 through chains and sprockets 86 and 87 respectively mounted outside the casing on one end of the roll shafts. Intermeshing gears 89 are mounted on the other ends of the shafts of rolls 79 and 80, and of 81 and 82 to drive the rolls 80 and 82 in counter rotations to the rolls 79 and 81 as shown in FIG. 9. An inclined feed chute 90 is provided within the casing 75 to receive the material entering through the inlet 76 and direct that material between the rolls 79 and 80 in a uniform thin stream.

As the material passes between the upper rolls, the product pieces are crushed and reduced in size. The material then passes between the lower rolls where it is reduced to a powder. Although all of the edible product is pulverized by the action of the rolls, the spacing between the rolls is sufficient to prevent cutting of wrapper material or tear tapes.

Figure 12:
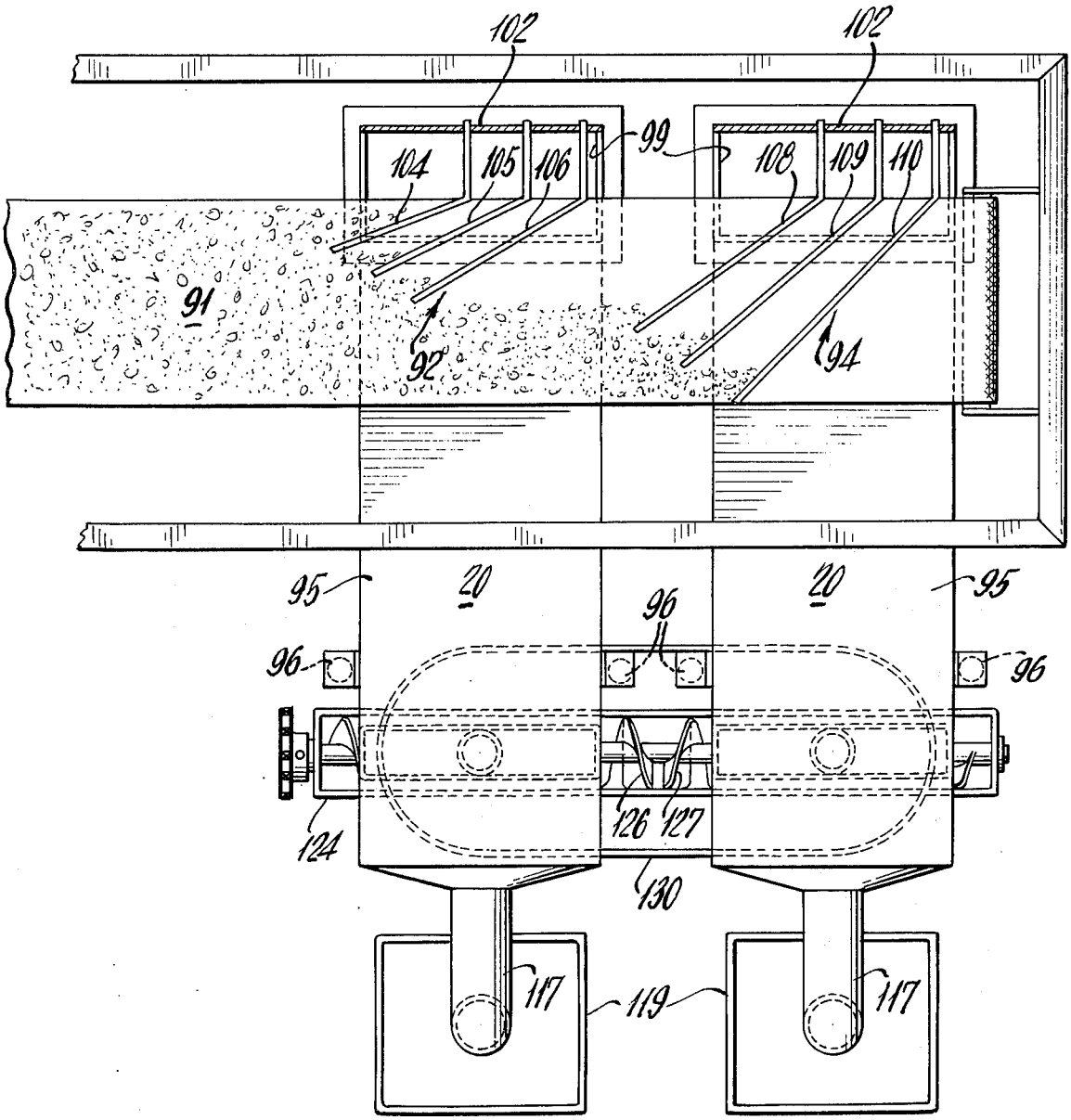
FIG. 12 is a plan view taken along line 12—12 in FIG. 9 showing the conveyor arrangement feeding the final separating stage.

The ground edible product, together with the remaining wrapper shreds and tear tapes, are deposited upon a conveyor belt 91 and carried against two sets of deflecting arms 92 and 94 which slide the material off the edge of the belt 91 into the two screen separators 20, as best shown in FIG. 12.

Figure 13:
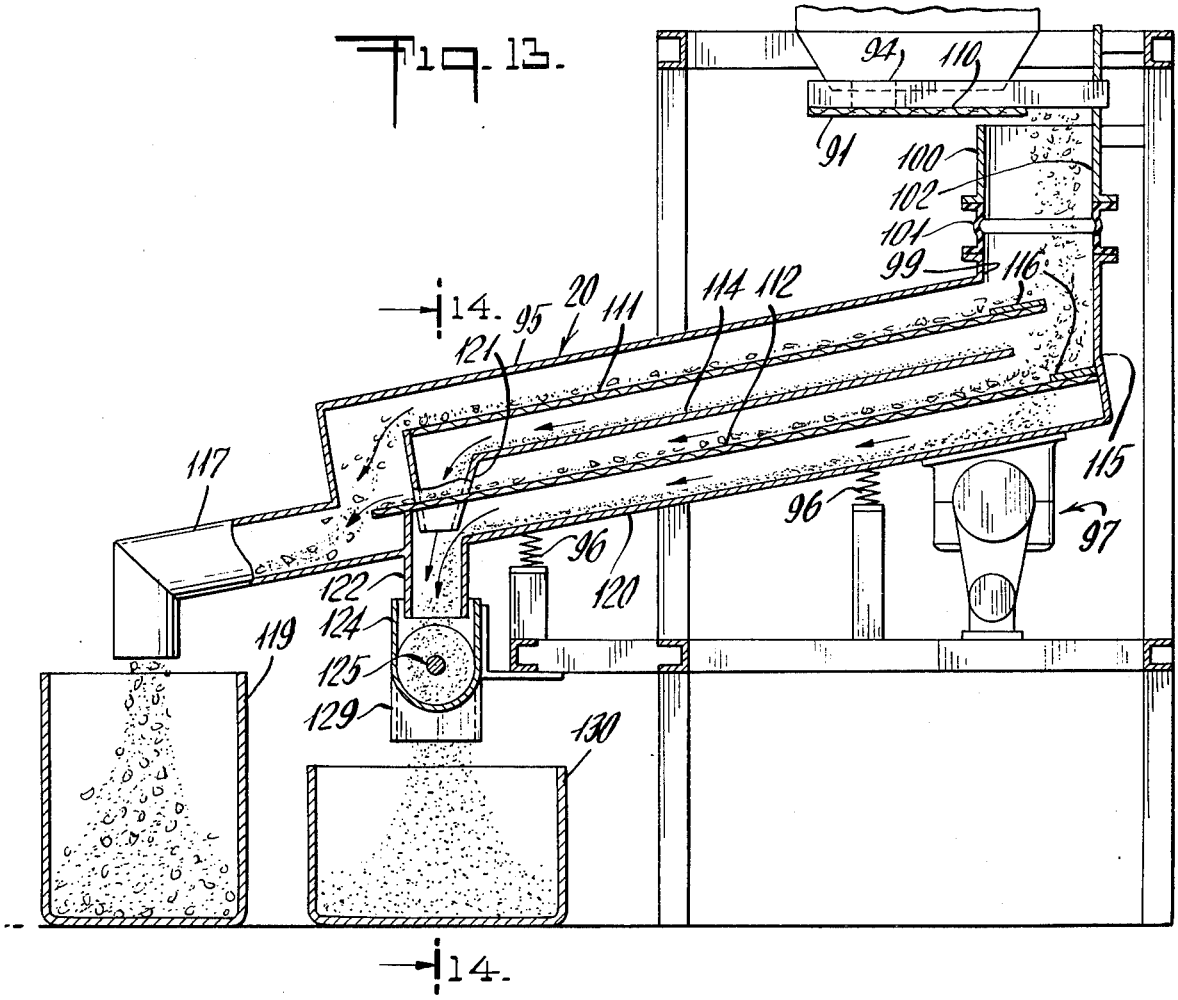
FIG. 13 is a sectional view of one of the double deck screen shaker shown in FIG. 12.

The screen separators 20 (as shown in FIG. 13) each include a rectangular casing 95 mounted at an angle on springs 96 and vibrated by a shaker mechanism 97. The casing 95 is provided with an inlet 99 to which a rigidly mounted duct 100 is connected through a flexible gasket 101. The deflecting arm sets 92, 94 (FIG. 12) are mounted to the rear wall 102 of the duct 100. The set of arms 92 includes three angled members 104, 105, 106 which extend out over the conveyor belt different distances so that they remove all material from the rear half of the belt. The set of arms 94 also include three angled members 108, 109, 110 which extend out over the conveyor belt in a similar manner to remove all the material from the front half of the belt. The angled members are positioned so that each removes the material from one sixth of the belt width, and the three members in each set are positioned so that the material they remove is distributed evenly across the inlet 99.

Figure 14:
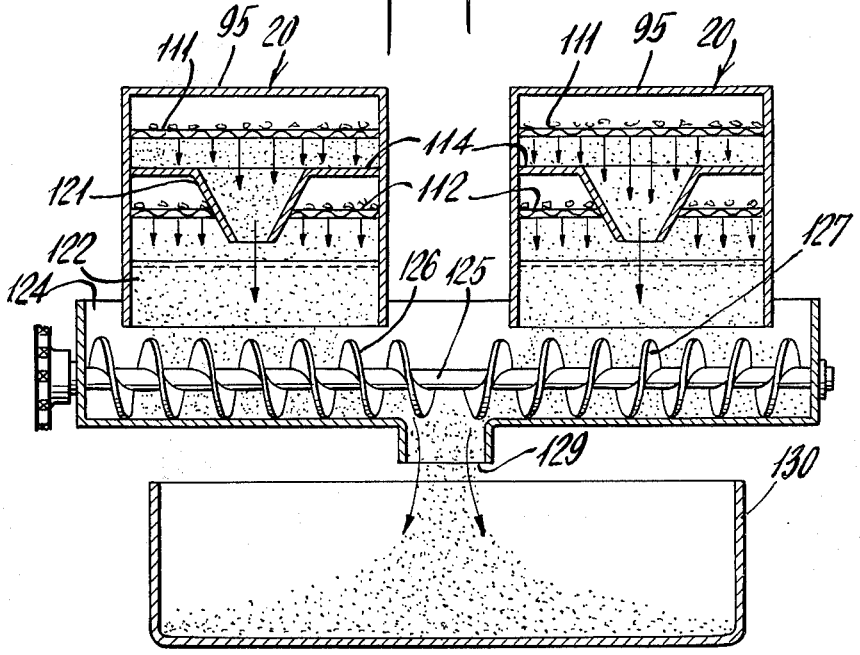
FIG. 14 is a sectional view taken along line 14—14 on FIG. 13.

Referring to FIGS. 13 and 14, the screen separators 20 are provided with an upper screen 111 and a lower screen 112 with a plate 114 positioned therebetween. The screen 112 extends to the back wall 115 of the casing 95 while the screen 111 extends mid way across the inlet 99. Therefore, the material flowing into each of the separators 20 is divided, about half being deposited on the upper screen and half on the lower screen. A plate 116 is positioned on the end of each screen to prevent slivers or wrapping paper, which have been vertically oriented by the fall through the duct 100, from striking the screen end on and passing through.

The screens 111 and 112 are of 16 mesh and are formed from wires not exceeding 0.009 inch in diameter, the wires being spaced to provide a clear opening between adjacent wires of 0.0535 inch. It has been found that larger diameter wires cause certain materials, such as peanut butter, to build up on the screen and interfere with the operation of the separators.

As the separators 20 vibrate in response to the shaker mechanisms, the material moves down the screens 111 and 112. The edible product has been ground to a size which will pass through the screens while the wrapper shreds and tear strips lie flat on the screens and move down to the discharge end. The wrapper material slides off the low end of the screens and flows through an outlet nozzle 117 into a bin 119. The pulverized edible product falls through the screens and flows down the plate 114 and the bottom wall 120 of the casing 95 to outlet formations 121 and 122. The upper outlet formation 121 extends through the lower screen 112 into the lower outlet 122.

Each of the outlet formations 122 extend into a trough 124 which is provided with a driven shaft 125 having opposed screw flights 126, 127 thereon to move the pulverized edible material through a central outlet 129 into a bin 130.

It will be seen that the present invention provides a simple and effective system for processing packages of edible products to economically separate the edible products from the packaging material and produce a comminuted edible product usable as an ingredient in baked products and thereby provides a means for reclaiming cookies, crackers, biscuits and the like.

What we claim is:

1. A system for producing comminuted edible product by reclaiming baked products in rejected packages comprising in combination means at a first station for receiving the rejected packages, conveyor means feeding the rejected packages to a second station, means at said second station for shredding the packaging materials and dividing the product into pieces, aspirating means for separating unencumbered wrapper shreds from product pieces and wrapper sections encumbered by product pieces, means for transporting the product pieces and encumbered wrapper sections to a third station, means at said third station for comminuting all of the product pieces without cutting the wrapper sections, and means for separating the comminuted product from the wrapper sections.

2. A system according to claim 1 wherein said aspirating means includes an inclinded screen, means for shaking the screen, an air jet below the screen to lift wrapper shreds, and a vacuum duct above the screen to draw away the wrapper shreds.

3. A system according to claim 1 wherein said means for separating the comminuted product from the wrapper sections includes an inclined screen and means for shaking said screen.

4. A system according to claim 1 wherein said shredding means at said second station cuts the packaging materials into about ¼ inch strips.

5. A system according to claim 1 wherein said comminuting means includes a pair of spaced rollers between which the product pieces and encumbered wrapper sections are passed.

6. A system according to claim 3 wherein the outer surfaces of said rollers are formed with teeth and the rollers are positioned to provide a space between the opposing teeth of the two rollers.

7. A system according to claim 6 wherein said comminuting means includes first and second sets of opposed horizontally oriented rollers, the first set having teeth extending along each roller from one end to the other and the second set having teeth extending along one roller from one end to the other and teeth extending circumferentially around the other roller in a generally vertical plane.

8. A system according to claim 7 wherein said second set of rollers is positioned vertically above said first set of rollers and product pieces and encumbered wrapper sections are fed first through the second set of rollers and then through the first set of rollers by gravity.

9. A system according to claim 8 wherein said teeth on said rollers of said first set extend at an angle of 15 degrees to the axis of the rollers.

10. A system according to claim 9 wherein said teeth extending from end to end on said one roller of said second set extend in a direction parallel to the axis of that roller.

* * * * *